United States Patent [19]

Miller

[11] Patent Number: 4,526,339

[45] Date of Patent: Jul. 2, 1985

[54] BLOWOUT PREVENTER

[75] Inventor: Charles J. Miller, Menlo Park, Calif.

[73] Assignee: Universal Well Control Systems, San Francisco, Calif.

[21] Appl. No.: 609,554

[22] Filed: May 11, 1984

[51] Int. Cl.[3] ..... F16K 3/02

[52] U.S. Cl. ..... 251/1.3; 251/329; 251/366; 251/367

[58] Field of Search ..... 251/1 A, 1 R, 329, 366, 251/367; 285/150

[56] References Cited

U.S. PATENT DOCUMENTS

| | | | |
|---|---|---|---|
| 1,352,423 | 9/1920 | Arbon | 251/1 R |
| 2,986,367 | 5/1961 | Le Rouax | 251/1 A |
| 3,392,994 | 7/1968 | Moore | 285/156 |
| 3,554,480 | 1/1971 | Rowe | 251/1 A |
| 3,955,622 | 5/1976 | Jones | 166/0.5 |
| 4,239,263 | 12/1980 | George | 285/150 |

FOREIGN PATENT DOCUMENTS

| | | | |
|---|---|---|---|
| 257902 | 9/1927 | United Kingdom | 251/1 A |

OTHER PUBLICATIONS

"Quadram Enhances Drilling Safety", Charles J. Miller, *Offshore Magazine* 9/1982, pp. 117–119.

*Primary Examiner*—Samuel Scott
*Assistant Examiner*—Allen J. Flanigan
*Attorney, Agent, or Firm*—Flehr, Hohbach, Test, Albritton & Herbert

[57] ABSTRACT

A blowout preventer of the cross ram type has at least a first and second pair of rams which are in the same plane or on the same level. The rams are reciprocable in insertable sleeve-like ram guideways which are replaceable to accommodate different types of rams; for example, a pipe ram or blind ram, or different configurations of rams from different manufacturers. This provides a blowout to preventer which has flexible functions and a low stack height and low weight. A spherical shape also provides lower weight, ease of guideway insertion, and reduction of stress concentrations.

4 Claims, 14 Drawing Figures

BLOWOUT PREVENTER

The present invention is directed to a blowout preventer and more specifically to a preventer of the cross ram type where first and second pairs of rams on the same plane provide for flexibility. The invention, of course, is particularly used in the drilling of oil and gas wells and related services; i.e., snubbing and workover.

BACKGROUND OF THE INVENTION

Cross rams in a blowout preventer, that is, rams which have at least two opposed pairs, are disclosed in U.S. Pat. No. 3,554,480 to Rowe as inventor and assigned to Cameron Iron Works, Inc. As discussed in that patent, an advantage of a cross ram is the flexibility in, for example, providing pipe-type rams which close around an oil-well drilling pipe or blind rams which block the well completely. Other major advantages of a cross-type ram is the reduction in the so-called blowout preventer stack height and weight.

More specifically, as is well-known in the oil-well drilling art, for safety purposes many different ram functions are desired when drilling a well. To accomplish these many functions, both cross rams and for that matter the more typical single ram pair are stacked one on top of the other sometimes requiring stacks of six dual rams. Because of the high pressures involved, the bodies of the preventers are relatively thick and thus the distance from the wellhead to the drilling deck is very large. A typical distance might be more than 45 feet. In addition, a large stack of blowout preventers has a very heavy weight and may tend to stress the wellhead. A two-unit stack of dual-type blowout preventers is shown in Allen U.S. Pat. No. 2,912,214. The bulk of the body and its height is quite apparent.

Thus, the cross ram discussed above is a partial answer to the problems of flexibility and both blowout stack height and weight. But there are remaining problems of flexibility, pressure resistance which is very great in oil-well environments and ultimate stack heights.

Thus, it is an object of the present invention to provide an improved blowout preventer.

It is a more specfic object to provide a blowout preventer which is more flexible and has more functions on one level.

It is another object of the invention to provide a blowout preventer which has a great number of functions but yet a relatively lower stack height.

It is another object of the invention to provide increased pressure capabilities without increasing the overall size and weight of a preventer component.

In accordance with the above objects, there is provided a blowout preventer comprising a substantially spherical body having a vertical bore for accommodating a drill string of an oil or gas well and first and second pairs of opposed bores radiating laterally in a common plane from the vertical bore. First and second pairs of replaceable sleeve-like ram guideways are inserted respectively into the first and second pairs of opposed bores. A pair of rams are reciprocable in each pair of the guideways for selectively sealing the vertical bore.

From a method standpoint, apparatus is provided as above and the first and second pairs of ram guideways are selected from a plurality of guideways each having different interior configurations. The selected guideways accommodate different types of rams. These guideways are then inserted into the first and second pairs of opposed bores of the blowout preventer and compatible-types of rams are then placed therein.

DETAILED DESCRIPTION OF PREFERRED EMBODIMENTS

Figure 1:
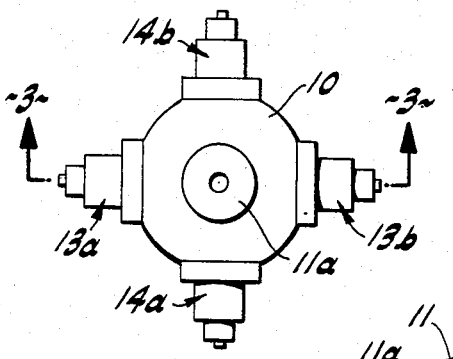
FIG. 1 is a top view of a blowout preventer embodying the present invention.
Figure 2:
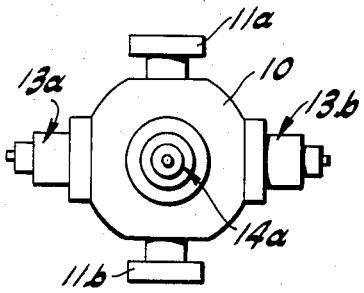
FIG. 2 is a side elevational view.
Figure 3:
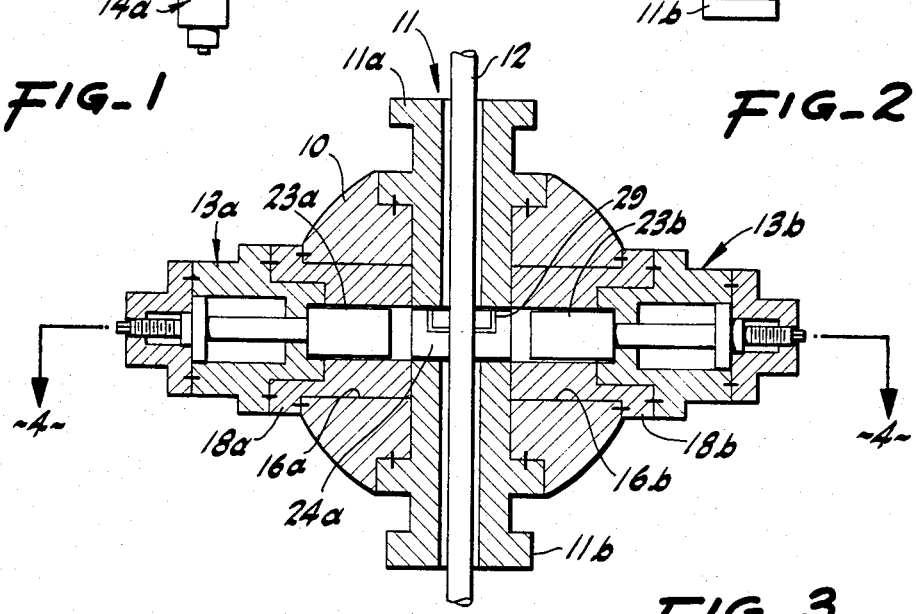
FIG. 3 is a cross-sectional view taken along the line 3—3 of FIG. 1.

FIGS. 1, 2 and 3 illustrate the basic cross ram blowout preventer of the present invention which includes as its main portion a substantially spherical body 10. As illustrated in FIGS. 2 and 3, the body has a vertical bore 11 through which extends a drill string 12. This is of an oil or gas well, for example. Then, as illustrated in FIG. 1, first and second pairs of ram assemblies, 13*a*, 13*b* and 14*a*, 14*b*, radiate laterally from the vertical bore 11 and are in the same plane as illustrated in FIG. 2.

Figure 4:
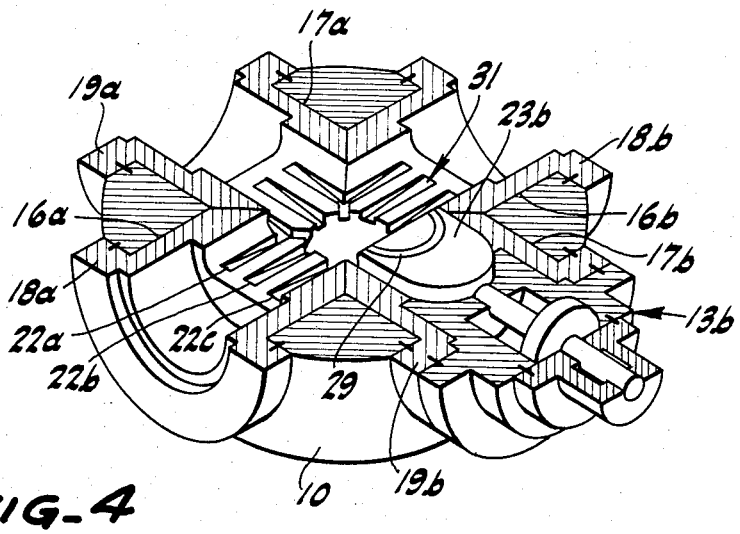
FIG. 4 is an enlarged cross-sectional view in perspective taken along the line 4—4 of FIG. 3 with some parts eliminated for simplicity.

Referring more specifically to FIG. 3, upper and lower collars 11*a* and 11*b* are inserted into the vertical bore 11 to accommodate the drill string 12. Spherical body 10 has in addition to the vertical bore 11 a first pair of opposed cylindrical bores 16*a*, 16*b* and as illustrated in FIG. 4 a second pair 17*a*, 17*b*. These bores are, of course, opposed and radiate in a common plane from the vertical bore 11. Inserted into each of these bores are selected pairs of ram guideways 18*a*, 18*b* and 19*a*, 19*b*. These guideways (or ram compartments—since they store the rams in their inactivated position) are better shown in FIG. 4. They are securely fastened to the spherical body 10 by either a screw or bolt-type fastening which are indicated schematically only. In any case, the fastening must be substantial to resist pressures of up to 25,000 pounds per square inch.

The pairs of replaceable sleeve-like ram guideways are in practice selected from several varieties of guideways illustrated in a cross-sectional form in FIGS. 5A through 5E. There are several manufacturers of rams each having their own configuration. And in fact several types of specific rams from the same manufacturer such as variable bore rams which are utilized for different diameters of drilling pipe and shear blind rams which in essence shear off the pipe and close the bore completely in case of emergency. To accommodate these various types and manufacturers, the cross-section of FIGS. 5A through 5E are illustrated. The interior configuration, for example, the oval-type section shown in 21 might accommodate a ram made by Cameron Iron Works, Inc. The modified guideway of FIG. 5B accommodates another manufacturer, the rectangle of FIG.

Figure 5A:
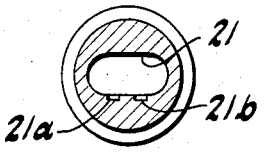
FIGS. 5A through 5E are different interior configurations of insertable ram guideways of the present invention.
Figure 5B:
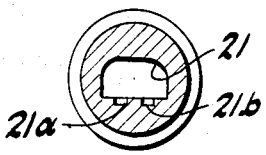
Figure 5C:
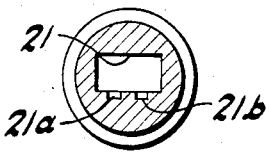
Figure 5D:
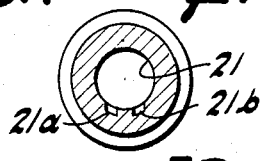
Figure 5E:
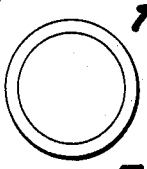

5C another and the circular guideway of FIG. 5D yet another. Finally, FIG. 5E illustrates a generalized circular cross-section shell in which any type of guideway might be accommodated.

Referring specifically to FIG. 5A, although the same is shown in the other figures, each guideway has sediment slits or grooves illustrated at 21*a*, 21*b* which accommodate sediment to prevent malfunctioning of the rams. These sediment grooves are also shown more clearly in FIG. 4 as illustrated at 22*a* through 22*c*.

First and second pairs of rams 23*a*, 23*b* and 24*a*, 24*b* are reciprocable in each pair of guideways for selectively sealing the vertical bore 11. Only one pair are fully illustrated in FIG. 3; FIG. 4 illustrates a single ram 23*b*; but FIG. 6 illustrates one pair 23*a*, 23*b* which is closed around the drill string 12 and the other pair 24*a*, 24*b* which is in an open position.

Figure 6:
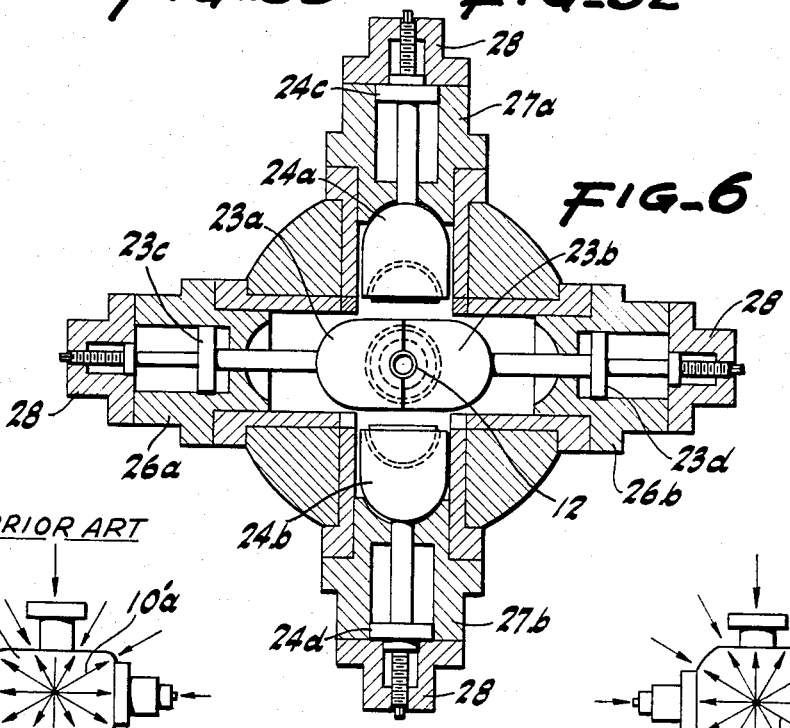
FIG. 6 is a cross-sectional view similar to FIG. 4 but showing more operational portions and in a non-perspective format.

As best illustrated in FIG. 6, the rams also include respective piston means 23*c*, 23*d* and 24*c*, 24*d* which are contained in their respective bonnets 26*a*, 26*b* and 27*a*, 27*b* encapped by headers 28. The technique of operating the piston and so on is well known in the art.

The present invention, referring to FIG. 4, provides for effective downstream sealing by means of the semicircular sealing surface 29 of the top of ram 23*b* (and for that matter all the other rams) which is a resilient material and which moves against the upper insert sleeve 11*a* illustrated in FIG. 3 when the ram is closed. In addition, the grooved portion of the ram guideway, that is, 22*a* through 22*c* of the grooves 31 are upwardly inclined from the vertical plane slightly in order to move the rams 23*a*, 23*b* and 24*a*, 24*b* into sealing engagement with the downstream surface of the blowout preventer.

Figure 7B:
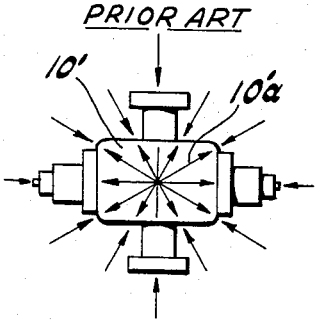
FIGS. 7A and 7B are force vector diagrams showing respectively a side elevation similar to FIG. 2 and a side elevation of a prior-type blowout preventer.
Figure 7A:
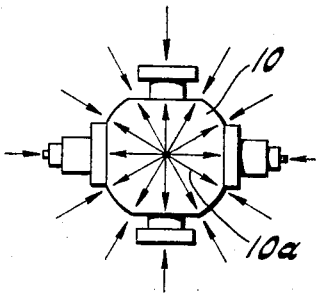

FIGS. 7A and 7B illustrate the comparative structural advantage of the substantially spherical construction of the body 10 of the present invention. For example, in a well, formation pressures may go up to 20,000 psi. And to be safe the body and associated components should withstand in modern wells 25,000 psi. At the present time, well blowout preventer pressures rarely can exceed 10,000 psi without drastically increasing the outermost body dimensions. For example, a typical commercial preventer with a single pair of rams, but of a double stacked configuration, might have an overall height of 27 $\frac{7}{8}$" for 5,000 psi working pressure and 35 $\frac{1}{8}$" for 10,000 psi - an 18% increase in height (even more in weight) for a 5,000 psi increase in pressure. More importantly, at pressures of 10 to 15 thousandths psi, the heights are 60 $\frac{5}{8}$" and 82.5"—a 33% increase.

With this spherical construction 10 of the present invention, the high stress concentrations caused by sharp corners are eliminated as illustrated by the radially extending vectors 10*a* in FIG. 7A. Weight reduction of 65 to 75% is provided. In comparison, note the stress concentration in a typical prior art block-like preventer body 10' which occur at the corners; for example, vector 10'*a*. Of course, these vectors can be reversed, as illustrated, to indicate either internal or external pressures - e.g., in subsea applications.

Figure 8A:
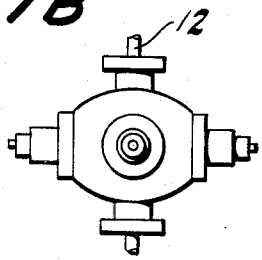
FIGS. 8A and 8B are side elevational views of two alternative embodiments of the invention.
Figure 8B:
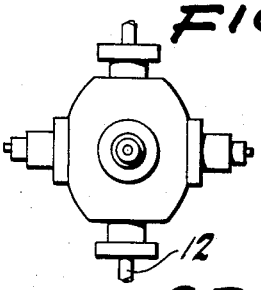

In addition, for some applications, ellipsoidal shapes which may still be regarded as substantially spherical in that it does eliminate sharp stress concentrations, may be used as illustrated in FIGS. 8A and 8B.

Thus, the present invention provides for increased flexibility, in view of the changeable insertable guideways, since one pair of rams could be a pair of the variable bore type and the other a pipe ram from another manufacturer. Thus, this would reduce the necessity for a high stack and weight of blowout preventers. Furthermore, the spherical-like main body of the blowout preventer, in addition to also reducing weight due to the reduction of stress concentrations, also allows the cylindrical bores to be easily drilled or casted in which the insertable sleeve-like guideways are placed.

Thus, an improved blowout preventer has been provided.

What is claimed:

1. A blowout preventer comprising:

a substantially spherical body having a vertical bore for accommodating a drill string of an oil or gas well and first and second pairs of opposed bores radiating laterally in a common plane from said vertical bore;

first and second pairs of replaceable sleeve-like ram guideways inserted respectively into said first and second pairs of opposed bores;

a pair of rams reciprocable in each pair of said guideways for selectively sealing said vertical bore.

2. A preventer as in claim 1 where each ram includes piston means in a bonnet mounted to said replaceable guideways.

3. A preventer as in claim 1 where said rams include downstream sealing surfaces.

4. A method of blowout prevention for oil or gas wells comprising the following steps:

placing a substantially spherical body having a vertical bore around a drill string;

providing in said body first and second pairs of opposed bores radiating laterally in a common plane from said vertical bore;

selecting first and second pairs of ram guideways from a plurality of guideways each having a different interior configuration to accommodate different types of rams therein;

inserting said selected pairs of ram guideways into said first and second pairs of opposed bores;

and placing within said guideways compatible types of rams.

* * * * *